US005883351A

United States Patent [19]

Castonguay et al.

[11] Patent Number: 5,883,351

[45] Date of Patent: Mar. 16, 1999

[54] RATCHETING MECHANISM FOR INDUSTRIAL-RATED CIRCUIT BREAKER

[75] Inventors: Roger N. Castonguay, Terryville; James L. Rosen, West Hartford; Andre J. M'Sadoques; Dean A. Robarge, both of Southington, all of Conn.

[73] Assignee: General Electric Company, Schenectady, N.Y.

[21] Appl. No.: 863,649

[22] Filed: May 27, 1997

[51] Int. Cl.[6] ..... H01H 33/02

[52] U.S. Cl. ..... 218/154

[58] Field of Search ..... 185/40 R, 40 A, 185/40 B, 40 C, 40 F, 40 H, 39; 192/12 R; 200/318–325, 330, 332, 337, 400; 218/1, 2, 7, 43, 68, 78, 84, 152, 153, 154

[56] References Cited

U.S. PATENT DOCUMENTS

| | | | |
|---|---|---|---|
| 3,084,238 | 4/1963 | Baskervill | 200/153 |
| 3,095,489 | 6/1963 | Baird | 200/153 |
| 3,689,720 | 9/1972 | Patel | 200/153 SC |
| 3,689,721 | 9/1972 | McGuffie | 200/153 SC |
| 3,729,065 | 4/1973 | Baskerville et al. | 185/39 |
| 3,773,995 | 11/1973 | Davies | 200/153 SC |
| 4,167,988 | 9/1979 | Acampora et al. | 185/40 R |
| 4,475,021 | 10/1984 | Mochizuki et al. | 200/153 SC |
| 4,672,501 | 6/1987 | Bilac et al. | 361/96 |
| 5,545,867 | 8/1996 | Castonguay et al. | 200/400 |

*Primary Examiner*—Michael A. Friedhofer
*Attorney, Agent, or Firm*—Fishman, Dionne, Cantor & Colburn; Carl B. Horton

[57] ABSTRACT

An air circuit breaker ratcheting mechanism includes a ratchet and pawl whereby the closing springs charging gear is prevented from reverse rotation during the closing springs charging operation. Upon completion of the charging operation, the ratchet and pawl become disengaged from the charging gear to allow the closing springs to respond to a manual closing, command. An operating handle pivot assembly allows a molded plastic handle operator to be employed and the ratcheting mechanism is arranged for modular assembly during the circuit breaker manufacturing process as well as motor to manual charge conversion one site.

13 Claims, 5 Drawing Sheets

RATCHETING MECHANISM FOR INDUSTRIAL-RATED CIRCUIT BREAKER

BACKGROUND OF THE INVENTION

Air circuit breakers as described within U.S. Pat. Nos. 3,095,489 entitled "Manual Charging Means for Stored Energy Closing Mechanisms of Electric Circuit Breakers" and 3,084,238 entitled "Ratchet Mechanism for Charging a Closing Spring in an Electric Circuit Breaker" include operating mechanisms that are mainly exposed to the environment. Since the air circuit breakers are rated to carry several thousand amperes of current continuously, the exposure to convection cooling air assists in keeping the operating components within reasonable temperature limits.

Such air circuit breakers are usually provided with a motor operator such as described in U.S. Pat. No. 4,167,988 entitled "Ratcheting Mechanism for Circuit Breaker Motor Operator" or a manual handle as described in U.S. Pat. No. 3,729,065 entitled "Means for Charging A Stored Energy Circuit Breaker Closing Device" for charging the powerful closing springs contained within the air circuit breaker operating mechanism.

As described within the aforementioned U.S. Pat. No. 4,167,988, the ratchet mechanism includes a driving pawl coupled with the motor operator for incrementally advancing a ratchet wheel coupled with the circuit breaker operating mechanism. Each incremental advance of the ratchet wheel is sustained by a holding pawl. Ultimately, the ratchet wheel is advanced to an angular position where the circuit breaker closing springs are fully charged and therefore empowered to forcibly close the circuit breaker contacts. Typically, the discharge of the closing springs rapidly drives the ratchet wheel in the same direction as did the driving pawl in charging the closing springs. In the process, the teeth on the ratchet wheel impact with the driving and holding pawls, producing undue pawl and ratchet wear, as well as unnecessary stress on the pawl springs and mountings. Moreover, when the breaker contacts close, there is an inevitable rebound which tends to rotate the charging gear in a reverse direction. Under these circumstances, the straight sides of the ratchet teeth impact against the straight edges of the pawl tips, causing potentially damaging stresses in the ratcheting mechanism. The patent further suggests the use of a holding prop to hold the pawls out of engagement with the ratchet wheel until the closing springs have fully discharged to protect the pawls and the ratchet wheel from potential damage. When the contacts have become closed, the circuit breaker operating mechanism components are exposed to allow an operator to manually release the holding prop in order for the holding pawl to again become operative in re-charging the circuit breaker closing spring.

When the circuit breaker closing springs are brought to their fully-charged conditions, it is important that the springs do not become inadvertently discharged while an operator has hold of the charging handle in order to avoid damage to the ratchet mechanism and the associated air circuit breaker contacts. An early arrangement of a latching means to prevent rotation of a closing springs charging handle is found in U.S. Pat. No. 4,475,021 entitled "Air Circuit Breaker".

The motor operated circuit breaker and manual variation thereof both employ a common operating mechanism and contact arrangement such that either the motor variation of the ratcheting mechanism or the manual ratcheting mechanism is installed during the manufacturing process, usually at the time of installation of the operating mechanism. It would be advantageous to have a modular ratcheting mechanism whereby a common platform with minor variation could be employed with either a motor-operated circuit breaker, a manual circuit breaker or a combination thereof.

When a manual ratcheting mechanism is employed, there is a large force concentration on the manual operating handle, particularly in the vicinity of the operating handle pivot. Tale operating handle components are usually made of hardened steel to resist bending or wear over long periods of continuos use. The use of a simple inexpensive operating handle structure has heretofore been avoided.

One purpose of the invention is to provide a modular ratcheting mechanism that will fit the requirements of either a motor operator driven circuit breaker closing spring, a handle operator driven circuit breaker closing spring or a combination of both with minor adjustment to the ratcheting mechanism.

A further purpose of the invention is to utilize a simple and inexpensive circuit breaker operating handle capable of withstanding several thousand pounds of force without failure over long periods of continued usage.

A further purpose of the invention is to provide a means to disengage the charging pawl when the closing springs are released without damaging the charging system.

SUMMARY OF THE INVENTION

An air circuit breaker ratcheting mechanism includes a ratchet and pawl whereby the closing springs charging gear is prevented from reverse rotation during the closing springs charging operation. Upon completion of the charging operation, the charging pawl become disengaged from the charging shaft to allow the closing springs to respond to a closing button command. A positional locating pin interacts with the circuit breaker operating handle and the charging pawl to allow the closing springs to respond to the circuit breaker closing button without damage to the charging pawl. An operating handle pivot assembly allows a molded plastic handle operator to be employed and the ratcheting mechanism is arranged for modular assembly during the circuit breaker manufacturing process as well as motor to manual charge conversion one site.

DESCRIPTION OF THE PREFERRED EMBODIMENT

Figure 1:
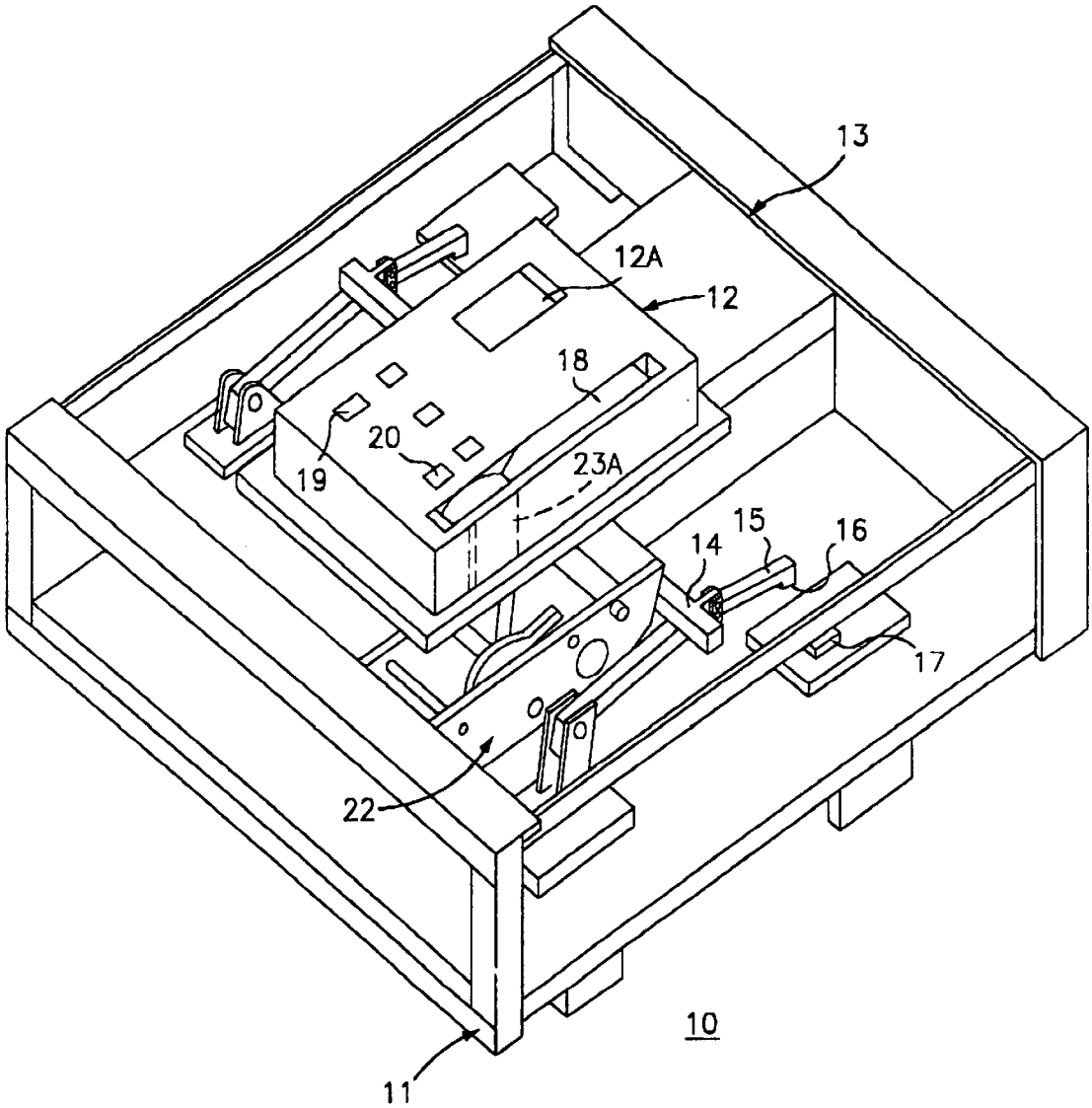
FIG. 1 is top perspective view of an air circuit breaker containing the ratcheting mechanism in accordance with the invention.

The air circuit breaker 10 of FIG. 1 is similar to that described within the aforementioned U.S. Pat. No. 3,095, 489 and includes a metal frame 11 which supports circuit breaker cover 12, the trip unit programmer 12 A is arranged on top of the operating mechanism enclosure 13. The trip unit programmer is similar to that described in U.S. Pat. No. 4,672,501 entitled "Circuit Breaker and Protective Relay Unit". The cover further includes a trip button 19 for releasing the circuit breaker operating mechanism contained within the cover 12 for separating the circuit breaker contacts 16, 17 to their open condition and a closing button 20 for moving the contacts to their closed position. The circuit breaker contact arms 15 within each pole of a three pole circuit arrangement, are interconnected by means of the operating mechanism crossbar 14 to insure that all contacts within the separate poles both open and close in unison. The ratcheting mechanism 22 improves over the earlier mechanism described in the aforementioned U.S. Pat. No. 3,729,065 by allowing the operating mechanism closing springs described therein to be charged remotely by means of a motor operator. The operating handle 18 interacts with the ratchet mechanism 22 by means of a pair of plate connectors, one of which is indicated at 23A.

Figure 2:
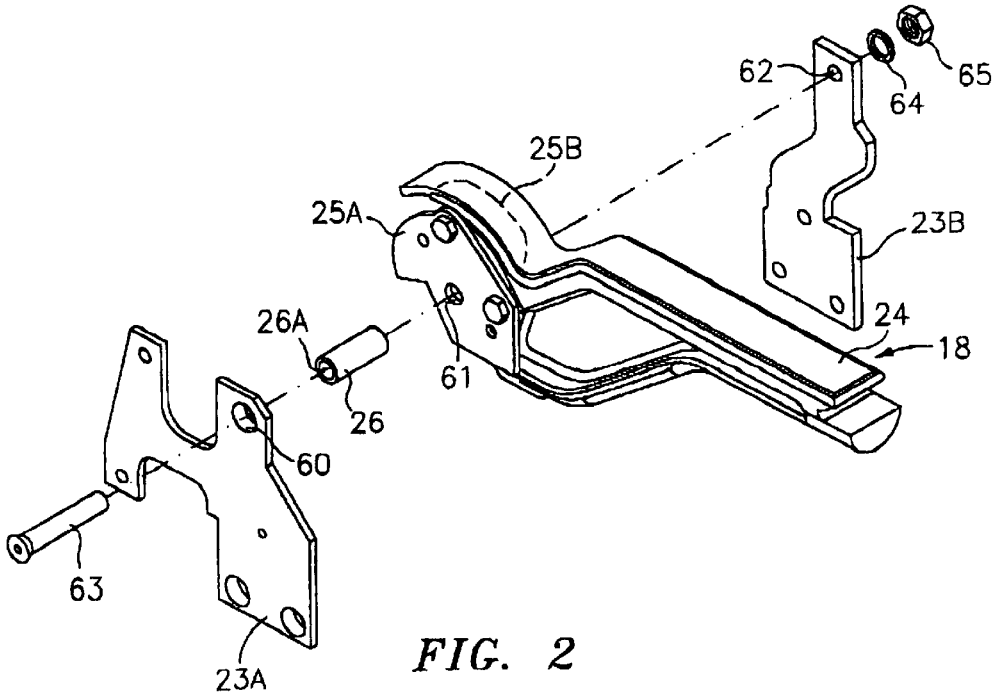
FIG. 2 is a top perspective view of the operating handle assembly within the ratcheting mechanism of claim 1.

The operating handle within the ratcheting mechanism is shown in FIG. 2 wherein the operating handle 18 includes a handle extension 24 fabricated from a molded plastic composition for manual manipulation attached to a pair of handle pivot plates 25A, 25B fabricated from hardened steel for interacting with the ratcheting mechanism. The handle pivot 26 is also fabricated from hardened steel and is in the form of a cylinder having a through hole 26A. The handle pivot plates are assembled onto a pair of connector plates 23A, 23B by means of a threaded bolt 63, apertures 60–62, washer 64 and nut 65. To allow free movement between the handle assembly and the supporting connector plates, the length of the handle pivot is set to position the connector plates such that sufficient clearance exists between the handle pivot plates and the connector plates to allow free movement of the handle with the least possible friction.

Figure 4:
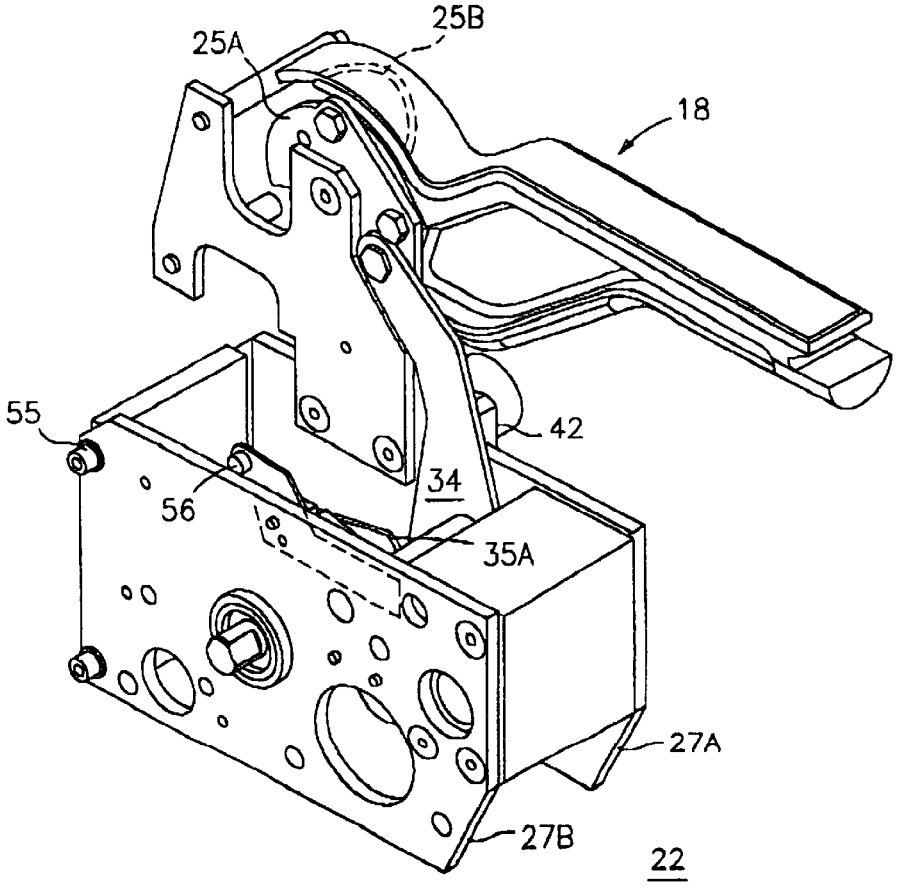
FIG. 4 is an enlarged top view of the completely assembled ratcheting mechanism of FIG. 3.
Figure 3:
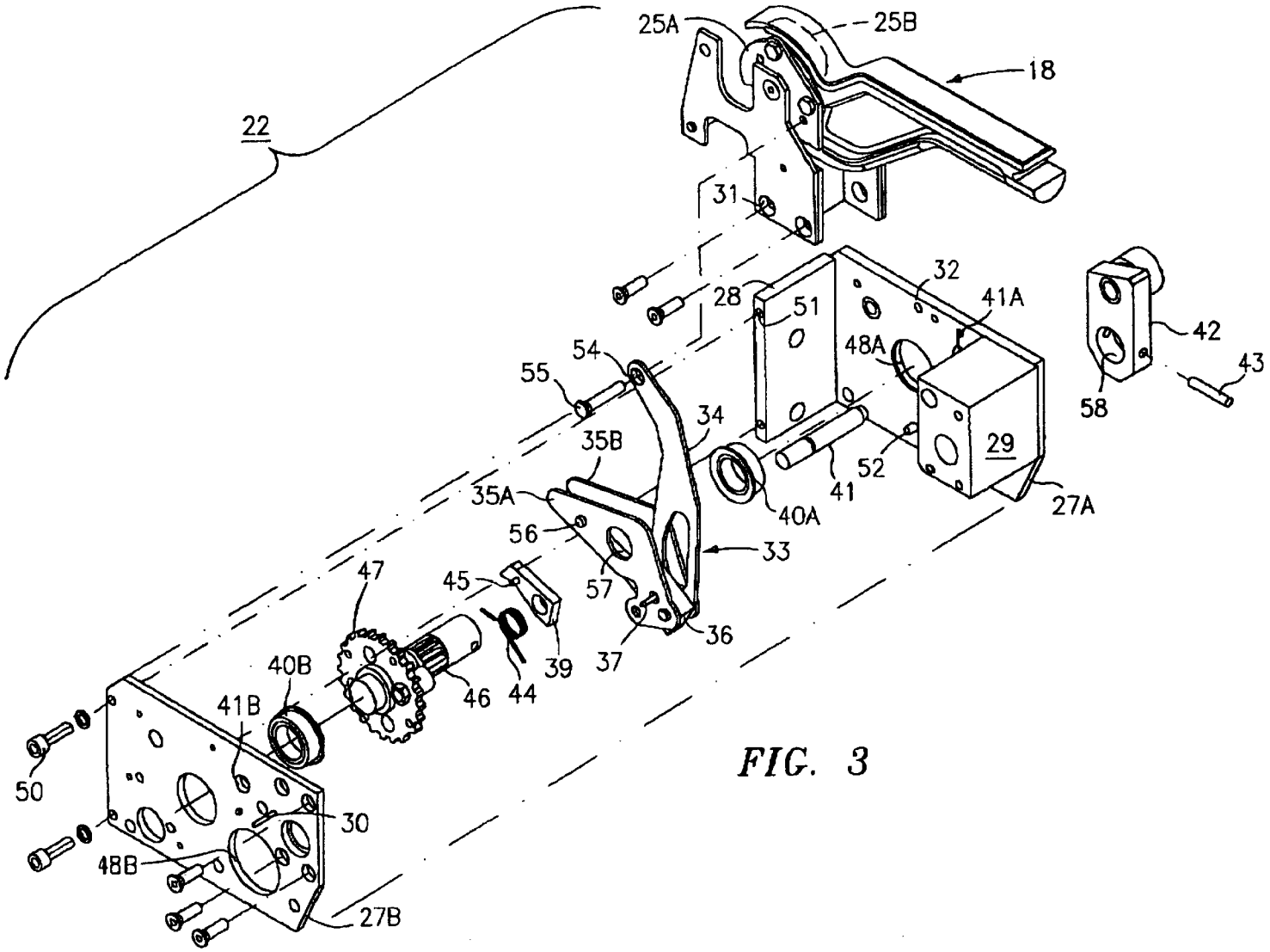
FIG. 3 is a top perspective view of the ratcheting mechanism of FIG. 1 with the components in isometric projection prior to assembly.

As shown in FIGS. 3 and 4, the operating handle 18 is positioned over the ratcheting mechanism 22 and attached to the ratchet mechanism sideframes 27A, 27B by means of threaded bolts 50, and threaded apertures 31, 32. The ratchet mechanism sideframes 27A, 27B are separated by means of block spacers 28, 29 which are connected to the sideframes by means of the threaded bolts 50 and threaded apertures 51, as indicated. The charging crank 33 includes a pair of charging cams 35A, 35B and intervening charging pawl 36 attached to the cams by means of the charging pawl tine 36A and is connected with the handle pivot plates 25A, 25B at an end opposite the charging pawl by means of aperture 54 in top of the charging link 34 and pin connector 55. The charging pawl return spring 38 (FIG. 5) connects with the charging crank 33 by means of the anchor pin 37 extending from the charging pawl 36. The charging cams 35A, 35B are interconnected together by means of the pin connector 56 and interact with the circuit breaker operating mechanism (not shown) by means of the operating mechanism coupling assembly 42 in the manner to be shown below. In further accordance with the invention, a charging shaft 46 is connected with the charging crank and extends through the bearing 40A , aperture 57 within the charging cams 35A, 35B. The charging shaft 46 passes through an aperture 48A in the sideframe 27A and seats within an opening 58 formed within the operating mechanism coupling assembly 42 and is retained therein by means of the coupling pin 43. The charging shaft 46 extends through the charging gear 47. A similar bearing 40B on the opposite side of the charging crank 33 receives the charging shaft which is supported by capture of the bearing within the aperture 48B formed within the sideframe 27B. The holding pawl 39 pivots on the shaft 41 which is captured in the apertures 41 A, 41 B in the sideframes 27A, 27B. The holding pawl return spring 44 is retained at one end against the anchor pin 45 extending from the holding pawl 39 and is retained at an opposite end by means of an anchor pin 30 which extends from the sideframe 27B. The interaction between charging pawl 36 and the positional locating pin 52 extending from the sideframe 27A will be discussed below with reference now to FIGS. 4 and 5.

In FIG. 4, the operating handle 18 is rotated in a counter-clockwise position which in turn rotates the charging shaft 46 in the counter-clockwise direction by transfer of the charging force through the handle pivot plate 25A to the charging link 34 attached to the pivot plate by means of the pin connector 55 when the handle is further rotated in the counter-clockwise direction about the handle pivot 26. The force is transmitted via the charging pawl 36 to the charging shaft 46 by engagement between one of the teeth 59 on the charging shaft by the tine 36A on the charging pawl. The charging pawl spring 38 biases the charging pawl 36 in the same direction to allow full engagement between the charging shaft teeth and the charging pawl tine as the operating handle 18 is rotated in the clockwise direction and again rotated in the same counter-clockwise direction. The holding pawl 39 interacts with the charging gear 47 by engagement between the teeth 58 on the charging gear and the tine 39A formed at the end of the holding pawl 39 to prevent clockwise rotation of the charging shaft 46. The bias force presented by the holding pawl return spring 44 insures engagement between the subsequent teeth 58 on the charging gear 47 as the charging shaft 46 is further rotated in the counter-clockwise direction.

Figure 5:
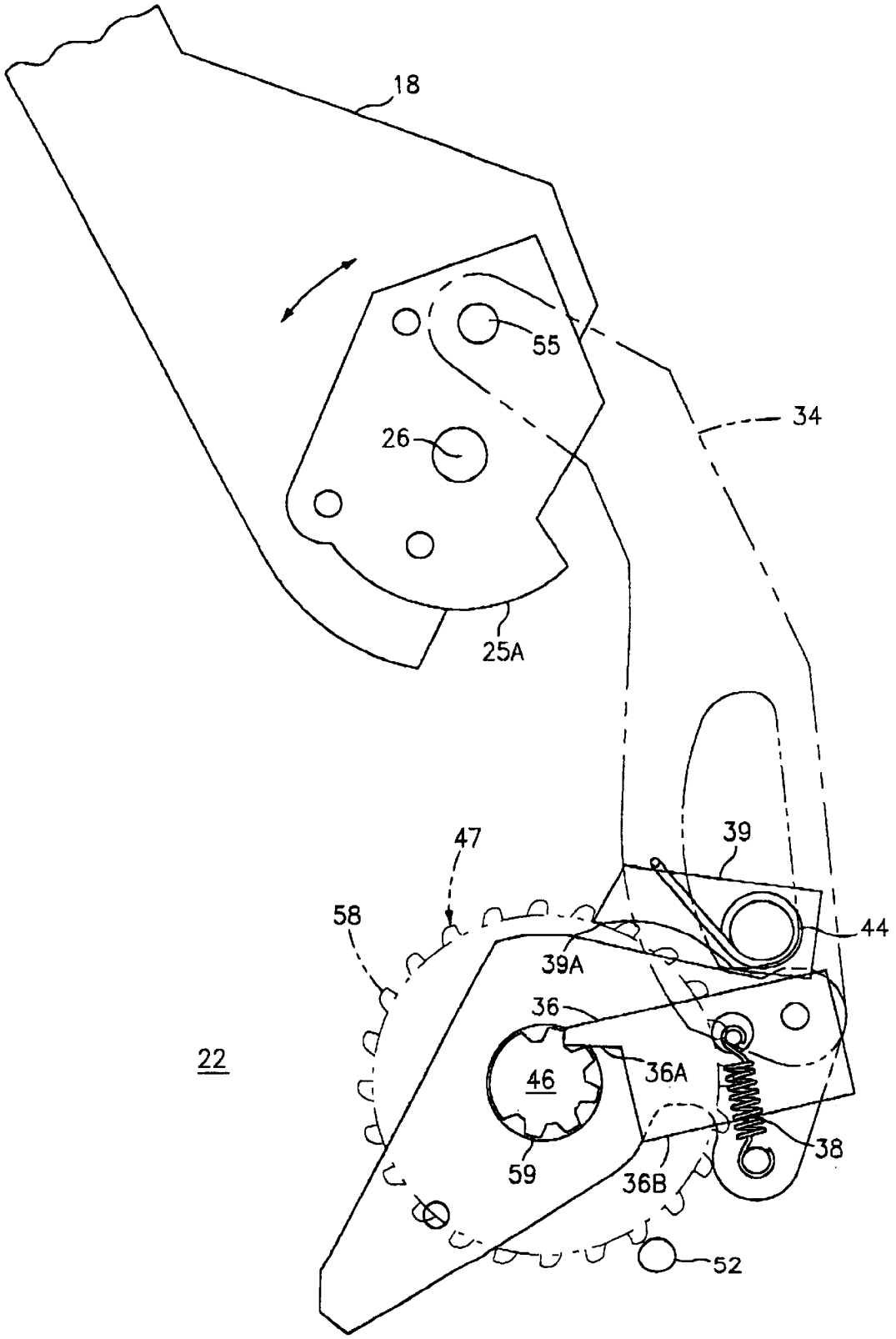
FIG. 5 is an enlarged side view of a part of the ratchet mechanism within the air circuit breaker of FIG. 1 before the circuit breaker operating mechanism closing spring has become fully-charged.
Figure 6:
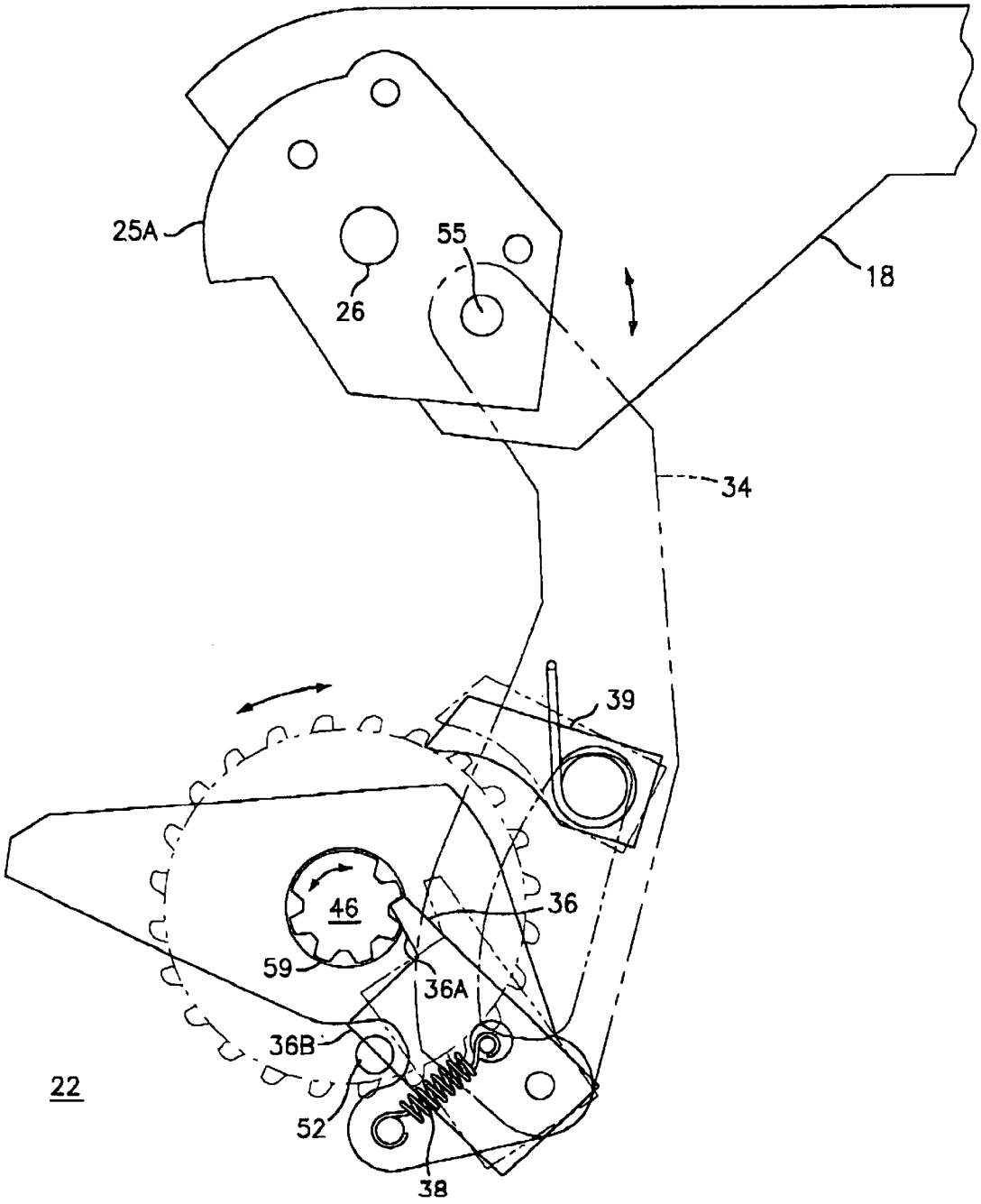
FIG. 6 is an enlarged side view of a part of the ratchet mechanism within the air circuit breaker of FIG. 1 after the circuit breaker operating mechanism closing spring has become fully-charged.

The function of the position locating pin 52 within the ratcheting mechanism 22 relative to the bottom 36B of the charging pawl 36 is best seen by referring now to FIGS. 5 and 6. The operating handle 18 is seen rotated in the clockwise direction to the "home" position which rotates the charging pawl 36 to the position indicated in solid lines whereby the bottom 36B of the charging pawl 36 strikes against the position locating pin 52. The interaction between the top of the position locating pin 52 and surface 36B on the charging pawl 36 forces the tine 36A out of engagement with the charging shaft teeth 59, as indicated in phantom.

It is thus seen how the operating handle 18 can be rotated to transfer charging force to the circuit breaker closing springs, and when returned to its home position, forces the charging pawl 36, upon contact with the position locating pin 52, to become safely disengaged from the teeth 59 on the charging shaft 46 to ensure against damage when the closing springs are released to close the circuit breaker contacts which often rebound to rotate the charging shaft momentarily in the reversed direction.

We claim:

1. A ratcheting mechanism for circuit breaker contact closing springs comprising:

a pair of opposing sideframes;

a charging pawl within said sideframes and arranged for interacting with a circuit breaker closing springs charging shaft;

an operating handle extending above said sideframes;

a charging link connecting between said operating handle and said charging pawl for transfer of charging force from said operating handle to said charging pawl;

a holding pawl engaged with said charging shaft to prevent reverse rotation of said charging shaft when said charging force is applied thereto; and means within said sideframes for disengaging said charging pawl from said charging shaft to thereby allow reverse rotation of said charging shaft to discharge said closing springs upon command.

2. The ratcheting mechanism of claim 1 wherein said operating handle comprises:

a plastic handle extension;

a pair of opposing metal handle pivot plates arranged at one end of said extension;

a metal cylinder extending through said pivot plates and abutting against a pair of metal connector plates, said metal cylinder being sized to provide clearance between said pivot plates and said connector plates when said plastic handle extension is rotated in a first direction.

3. The ratcheting mechanism of claim 1 wherein said means within said sideframes for disengaging said charging pawl comprises a position locating pin extending from one of said sideframes and arranged for contact with a bottom part of said charging pawl to limit rotation of said charging pawl when said circuit breaker operating handle is rotated in a second direction opposite said first direction.

4. A ratcheting mechanism for circuit breaker contact closing springs comprising:

a circuit breaker operating handle pivotally mounted intermediate a pair of opposing sideframes;

a pivot plate attached to said operating handle and arranged for pivotal rotation in unison with said operating handle;

a charging link having one end attached to said pivot plate and an opposite end attached to a charging pawl;

a charging shaft supported intermediate said sideframes and arranged for interacting with a circuit breaker operating mechanism closing spring; and a holding pawl mounted intermediate said sideframes, said holding pawl interacting with a charging gear on said charging shaft to prevent said charging shaft from rotating in a reverse direction.

5. The ratcheting assembly of claim 4 including circumferential teeth formed on said charging shaft and a tine on said charging pawl, said tine being retained by said circumferential teeth as said operating handle rotates said charging shaft.

6. The ratcheting assembly of claim 4 including a pair of charging cams, one of said charging cams being arranged on a side of said charging pawl.

7. The ratcheting assembly of claim 4 including a position locating pin extending from one of said sideframes, said position locating pin interfering with rotation of said charging pawl when said operating handle is rotated in an opposite direction.

8. The ratcheting assembly of claim 4 wherein said charging pawl is biased into engagement with said charging shaft by means of an extension spring.

9. The ratcheting assembly of claim 4 wherein said holding pawl is biased into engagement with said charging gear by means of a torsion spring.

10. The ratcheting assembly of claim 4 including a connector plate attached to one of said sideframes and further including means for receiving a pivot pin, said pivot pin pivotally attaching said operating handle to said one sideframe.

11. A circuit breaker comprising:

a support frame;

an operating mechanism within said support frame, said operating mechanism including a contact closing spring;

a movable contact arm interacting with said contact closing spring for opening and closing a pair of contacts;

a trip unit interacting with said operating mechanism for articulating said operating mechanism to separate said contacts upon command;

a pair of opposing sideframes;

a charging pawl within said sideframes and arranged for interacting with a circuit breaker closing spring charging shaft for charging said closing spring;

an operating handle extending, above said sideframes;

a charging link connecting between said operating handle and said charging pawl for transfer of charging force from said operating handle to said charging pawl;

a holding pawl engaged with a charging gear connected to said charging shaft to prevent reverse rotation of said charging shaft when said charging force is applied thereto; and means within said sideframes for disengaging said holding pawl from said charging shaft to thereby allow reverse rotation of said charging shaft to discharge said closing spring upon another command.

12. The circuit breaker of claim 11 wherein said operating handle comprises:

a plastic handle extension;

a pair of opposing metal handle pivot plates arranged at one end of said extension;

a metal cylinder extending through said pivot plates and abutting against a pair of metal connector plates, said metal cylinder being sized to provide clearance between said pivot plates and said connector plates when said plastic handle extension is rotated.

13. The circuit breaker of claim 12 wherein said means within said sideframes for disengaging said holding pawl comprises a position locating pin extending from one of said sideframes and arranged for contact with a bottom part of said charging pawl to limit rotation of said charging pawl when said circuit breaker operating handle is rotated in a reverse direction.

* * * * *